US005150477A

United States Patent [19]

Elberson et al.

[11] Patent Number: 5,150,477

[45] Date of Patent: Sep. 29, 1992

[54] HOSPITAL GOWN

[76] Inventors: Joyce E. Elberson, c/o Jacob and Betty Walters, Box 307, Saxton, Pa. 16678; Mary F. Ritchey, 435 Lincolnway Dr., York, Pa. 17404

[21] Appl. No.: 846,888

[22] Filed: Mar. 6, 1992

[51] Int. Cl.[5] ..... A41D 13/00

[52] U.S. Cl. ..... 2/114; 2/46; 2/48; 2/DIG. 7

[58] Field of Search ..... 2/46, 48, 50, 51, 69, 2/69.5, 75, 80, 105, 106, 114, 115, DIG. 7

[56] References Cited

U.S. PATENT DOCUMENTS

| | | | |
|---|---|---|---|
| 1,155,544 | 10/1915 | Bonoff | 2/114 |
| 1,497,685 | 6/1924 | Hoyme . | |
| 1,575,357 | 3/1926 | Milner . | |
| 2,680,850 | 6/1954 | Renard | 2/114 |
| 2,818,573 | 1/1958 | O'Donnell | 2/114 |
| 3,155,984 | 11/1964 | Derrick | 2/114 |
| 3,557,385 | 1/1971 | Hendrickson . | |
| 4,547,907 | 10/1985 | Netsky . | |
| 4,587,671 | 5/1986 | Rodriguez et al. . | |
| 4,837,863 | 6/1989 | Van Scoy-Mosher . | |
| 4,975,984 | 12/1990 | Sting . | |
| 5,001,784 | 3/1991 | Orlando, Jr. . | |

*Primary Examiner*—Werner H. Schroeder
*Assistant Examiner*—Jeanette E. Chapman
*Attorney, Agent, or Firm*—C. Hercus Just

[57] ABSTRACT

The invention comprises a gown of the type such as used in hospitals or offices of a physician to cover the torso and shoulder region of an otherwise relatively nude person, the gown including a relatively narrow front panel connected at one end to a substantially wider rear panel of which the elongated side portions comprise flaps of the latter and are adapted to be adjustably lapped over side edge portions of the front panel, the connected area of the panels having a head-receiving opening, and elongated tie members respectively extend from the outermost edges of the rear panel and across the front panel and are tied in a bowknot to detachably secure the respective panels in enclosing manner on the torso of a person while permitting ready arrangement of the panels to permit medical examination or for toilet purposes. A variation of the foregoing gown comprises a modification of one shoulder region of the gown by separating the region into a pair of small flaps adapted to be arranged in overlapping manner over the shoulder of the person and suitable additional tie members extend from the flaps and are adapted to be tied in a bowknot.

2 Claims, 3 Drawing Sheets

HOSPITAL GOWN

BACKGROUND OF THE INVENTION

Gowns of the type used especially in hospitals have been the subject of many improvements, especially in recent years as required by developments of techniques employed in the medical field. Some of the gowns have sleeves or sleeve-forming areas, while others omit sleeves. The present invention is of the latter type. In essence, the invention comprises a simple gown principally for use in a hospital and composed of a pair of front and rear panels connected at one end of each other in a manner to provide an opening through which the head of a person is projected to mount the gown on the patient.

The most pertinent prior patents on such general arrangement are as follows:

| | | |
|---|---|---|
| U.S. Pat. No. 1,497,685 | Hoyme | June 17, 1924 |
| U.S. Pat. No. 1,575,357 | Milner | March 2, 1926 |
| U.S. Pat. No. 3,557,385 | Hendrickson | Jan. 26, 1971 |
| U.S. Pat. No. 4,547,907 | Netsky | Oct. 22, 1985 |
| U.S. Pat. No. 4,587,671 | Rodriguez et al | May 13, 1986 |
| U.S. Pat. No. 4,837,863 | Van Scoy-Mosher | June 13, 1989 |
| U.S. Pat. No. 4,975,984 | Sting | Dec. 11, 1990 |
| U.S. Pat. No. 5,001,784 | Orlando, Jr. | March 26, 1991 |

Essentially, the patent to Hoyme shows a gown comprising a somewhat long rectangular panel with a central opening through which the head of a person extends and two slits respectively parallel to side edges of the panel extend from the end or one half of the panel to form tie members which extend through openings near the edge of the opposite half of the panel. The arrangement does not afford any appreciable wrap-around effect or overlapping of opposite edges of the panels.

The present invention also affords one alternate embodiment in which there is in one shoulder region of the gown a lateral opening extending from the head-receiving opening to one edge of the shoulder portion to form a pair of relatively short flaps which overlap when disposed on a person and a single pair of tie members permit tieing said members to form a shoulder-covering arrangement. Considering this in relation to the Netsky patent, it will be seen that two pairs of tie members are require and there are no overlapping members which provide greater comfort to a person wearing the gown. The remaining patents in the list are of general interest.

SUMMARY OF THE INVENTION

The gown comprising the present invention consists of a pair of integral front and rear panels formed from a unitary sheet of fabric so as to be connected integrally at one end of each to minimize seams and provide an area where an opening is formed which receives the head of a person when applying the gown, somewhat as basically shown in the patent to Hoyme but the front panel of the invention is relatively narrow and the rear panel is substantially wider to provide elongated flaps at opposite edges of the rear panel having smoothly tapering opposite edges and adapted for at least the wider portions of the tapering opposite edges respectively to overlap the edge portions of the front panel and provide substantially greater and more effective coverage of the torso of a person, yet affording easy access to and exposure of the torso for medical purposes, as well as affording ready rearrangement for toilet use.

An alternate arrangement of the gown of the invention is provided especially for persons who normally have trouble slipping a gown over their heads or who may have difficulty, such as when an arm is in a sling or for other reasons. The arrangement comprises providing one shoulder-receiving portion of the gown in the form of a lateral opening in which opposite portions of the region respectively comprise a pair of similar flaps which are adapted to be arranged in overlapping manner with each other and one shoulder of the person and a pair of tie members is attached respectively to said flaps in position to enable the flaps to be maintained in such overlapping manner which is comfortable when disposed over the shoulder of such person.

Still another advantageous feature of the invention is to provide all edges of the panels comprising the gown with binding of the type which is U-shaped in cross-section and receives the edge of the cloth panels and is secured by readily stitching the assembly together. Another advantage of such binding is that in addition to preventing ripping or tearing the panels of the gown, the various tie members are formed by desired lengths of such binding extending beyond the portions attached to the edges of the panels to provide tie members.

Detailed description of the foregoing objects and features of the invention, as well as other objects thereof, are set forth in the following specification and are illustrated in the accompanying drawings comprising a part thereof.

DETAILED DESCRIPTION OF THE PREFERRED EMBODIMENTS OF THE INVENTION

Referring to FIGS. 1–5, the preferred material used to form the gowns embodying the invention is a relatively tough fabric woven from a mixture of threads that are approximately 65% Fortrel and 35% cotton. The fabric of the preferred type is approximately 186 threads per square inch and is highly resistant to shrinking. The gowns used in hospitals and the like are subjected to relatively hard use, both in normal wearing on patients and also in laundering operations. The invention is not restricted to the foregoing type of material, however.

Figure 1:
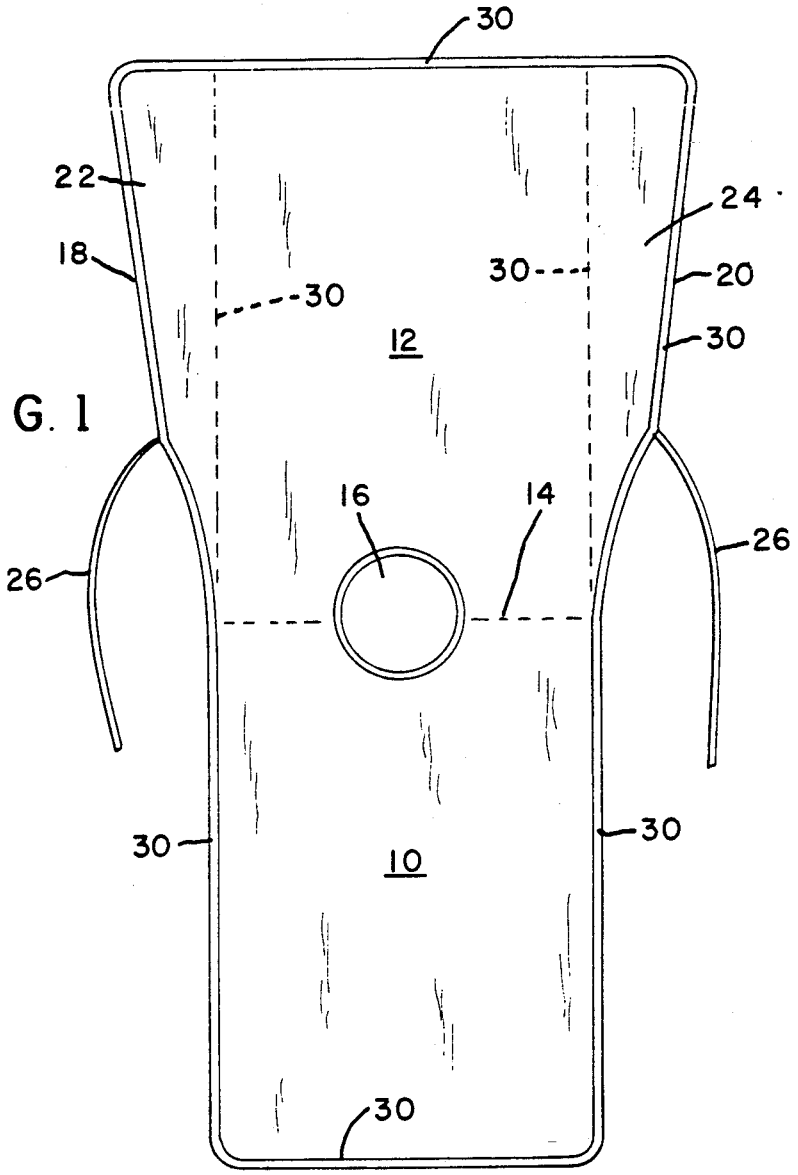
FIG. 1 is a plan view or layout of the basic overall shape of the gown comprising one embodiment of the invention.
Figure 3:
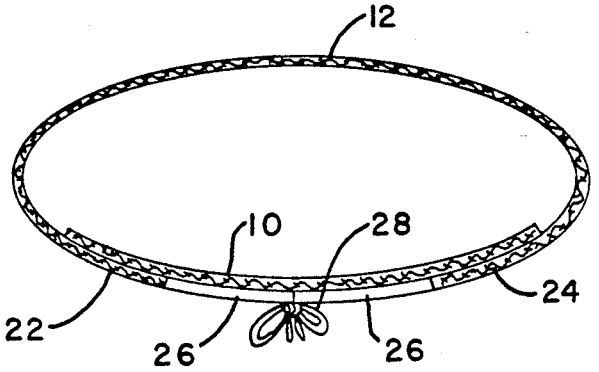
FIG. 3 is a section view of FIG. 2, as seen on the line 3—3 thereof and particularly illustrates the wrap-around effect of the front and rear panels of the gown as worn by a person and as shown on a larger scale than in FIG. 1.
Figure 2:
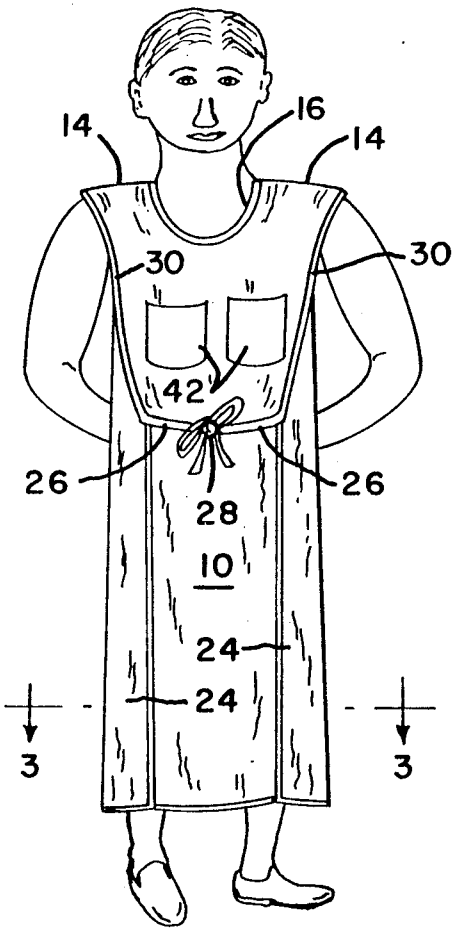
FIG. 2 is a front elevation of the gown shown in FIG. 1 when applied to a person's torso.

As shown in FIGS. 1-3, the simplest version of the invention comprises a relatively narrow front panel 10 having one end integral with one end of a substantially wider and smoothly tapering rear panel 12 whereby both panels are integral by being cut from a unitary panel of sheet textile material, thereby making seams unnecessary. Normally, the panels are folded along a shoulder line 14 and a head-receiving opening 16 is formed therein. The front panel 10, as seen in FIG. 1, is substantially rectangular with parallel opposite edges. The rear panel 12 has relatively distinct diverging and smoothly tapering outer opposite edges 18 and 20. Both the front and rear panels are approximately the same length. Due to the edges 18 and 20 diverging relatively equally, the side portions of the rear panel 12 which present the extra diverging edges comprise elongated flaps 22 and 24, defined by illustrative dotted lines in FIG. 1.

Figure 6:
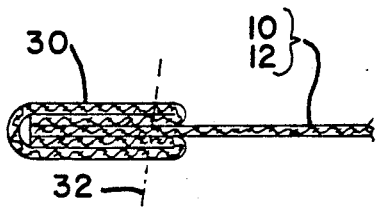
FIG. 6 is a section view of binding of the type connected to all cut edges of material from which the gown is made.

Intermediately of the side edges of the rear panel 12, elongated tie members 26 are connected at one end to flaps 22 and 24 of the real panel 12. In the preferred construction of the gown, preferably all of the cut edges of the material from which the panels 10 and 12 are formed are provided with channel-type textile binding 30, an example of which is shown on a larger scale in cross-section in FIG. 6. The binding is tightly woven from durable threads and is stitched to the edges of the fabric of the gown as indicated by dotted lines in FIG. 6. Such binding serves the double purpose of lending durability to the edges of the gown and also provides comfort to the wearer as distinguished from a simple overlapping hem being formed on all edges. Additionally, the binding presents a neat finish to the gown. Further the binding, when stitched with no fabric inserted therein, readily serves to provide tie members easily formed into a bowknot, as illustrated in the drawings.

Figure 5:
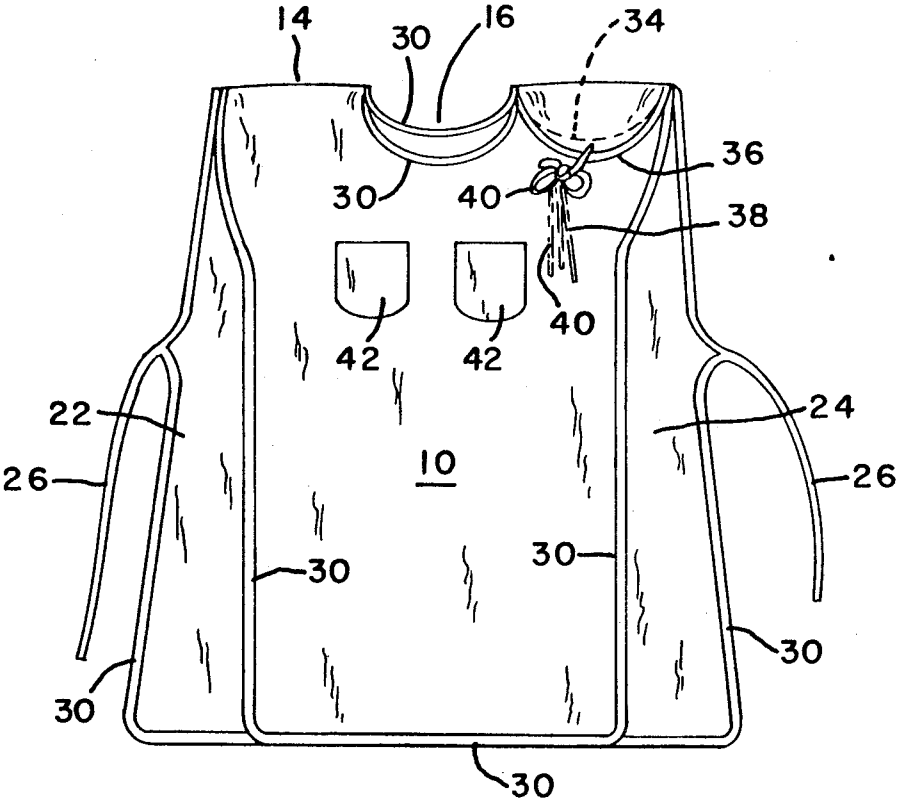
FIG. 5 is a front view of the modified embodiment shown in FIG. 4 and illustrating the front and rear panels of the gown in flat overlying relationship.

The significance of the amount of material allowed for the wrap-around flaps 22 and 24 is illustrated in FIG. 5, wherein front panel 10 is shown in flat condition overlying rear panel 12 beneath it and the outer edge portions of panel 12 which comprise flaps 22 and 24, are clearly shown.

Figure 4:
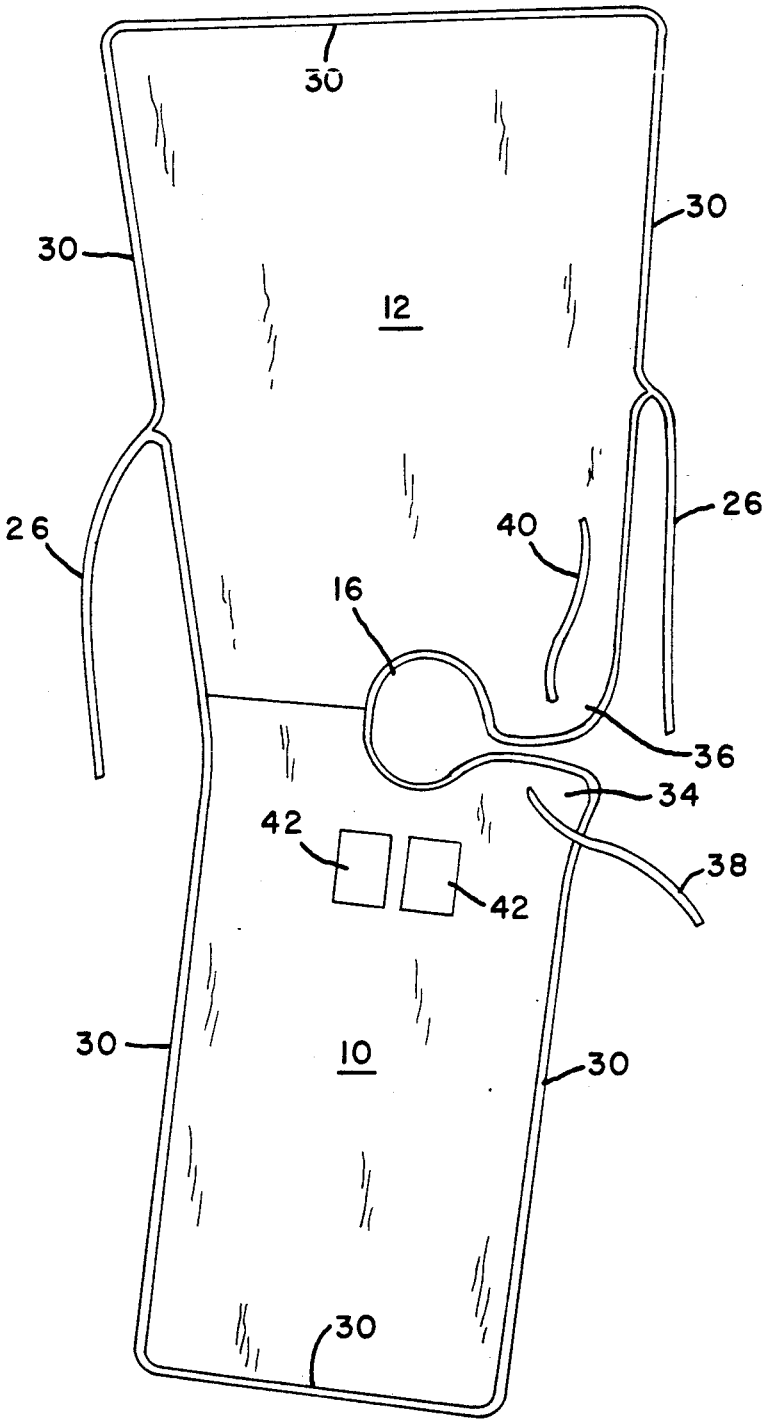
FIG. 4 is a modification of the embodiment shown in FIG. 1 which provides a change in the area of one shoulder region to assist in applying the gown to a certain type of handicapped person.

Referring to FIGS. 4 and 5, a variation is shown over the structure of the gown shown in FIGS. 1-3. In FIG. 4, basically, the front and rear panels 10 and 12 of the gown are substantially the same or very similar to those shown in FIGS. 1-3. However, it is known from practice in hospitals and doctors' offices that some patients cannot move their arms as freely as normal or it is difficult to slip the opening of a gown over a patient's head. To accommodate patients who have such difficulties, attention is directed to FIGS. 4 and 5.

In FIGS. 4 and 5, it will be seen that the shoulder area of the gown is modified relative to one side thereof and wherein one side of the head-receiving opening is extended laterally to separate the portions of panels 10 and 12 adjacent one side of opening 16 to form a pair of relatively small additional flaps 34 and 36. To enable the gown to be placed operatively upon a patient, the flaps 34 and 36 are extended around the neck of the patient and are placed in overlying arrangement, as shown in FIG. 5, and a pair of additional tie members 38 and 40 are secured at one end respectively to said flaps in spaced relation to the outer ends thereof and are utilized to secure the overlapping flaps comfortably over the shoulder of the patient without requiring any movement of the patient's arms and the tie members are secured into a single connection such as a bowknot. If desired, a pair of pockets 42 may be formed on front panel 10.

From the foregoing, it will be seen that the present invention provides a gown suitable for use upon a patient in a hospital or in a physician's office to permit inspection of the torso and shoulder area of a patient or for use upon a patient while occupying a hospital room of any kind. The greater amount of wrap-around nature is advantageous as compared with gowns of the prior art, such as in the patent to Hoyme. Further, the modified version shown in FIGS. 4 and 5 is far more simple than the gown of the Netsky patent.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

We claim:

1. A one-piece hospital gown formed from a unitary area of woven sheet-like material and comprising a relatively narrow front panel having parallel opposite side edges and being of predetermined length and said front panel being integral at shoulder regions with a corresponding end of a wider rear panel of which opposite side edge portions comprise integral elongated flaps having smoothly tapering and diverging outer edges respectively adapted to overlap appreciable opposite side edge portions of said front panel in a manner to effectively cover especially a person's torso when wearing the gown, said gown also having an opening in said shoulder region where said panels are integrally connected and through which a person's head is adapted to extend when mounting the gown for wearing, and said flaps respectively intermediately of said opposite elongated edges thereof having elongated tie members connected to and formed by extensions of channel-type textile binding extending around and secured to substantially all edges of said integral front and rear panels and said tie members being adapted to extend across the exterior of said front panel when the gown is worn and are releasably connected to each other, said arrangement of the panels being such as to provide substantially complete encirclement and coverage of the torso of a person when wearing said gown and said panels being adapted to permit ready movement thereof to expose said torso of the person for medical, as well as toilet operations.

2. The gown according to claim 1 further including at one side of said head opening a separation of one shoulder region of the gown in a manner to provide a pair of flap members arranged and adapted to extend in overlapping manner to each other over one shoulder of a person wearing the gown, and additional tie members respectively attached at one end to said flap members in spaced relation to the outer ends thereof in a manner to be tied in a bowknot to connect said flap members in said overlapping relation and thus permit the gown to be used by persons not able to extend their heads through said openings or otherwise.

* * * * *